United States Patent [19]

Vuaille

[11] 3,985,474

[45] Oct. 12, 1976

[54] HYDRAULIC HEADS FOR INJECTION PUMPS AND THE INJECTION PUMPS THEMSELVES

[75] Inventor: Andrë Vuaille, Lyon, France

[73] Assignee: Sigma Diesel, Venissieux, France

[22] Filed: Sept. 4, 1974

[21] Appl. No.: 503,078

[30] Foreign Application Priority Data

Sept. 12, 1973 France ..... 73.32846

[52] U.S. Cl. ..... 417/490; 123/139 R; 417/501

[51] Int. Cl.[2] ..... F04B 7/04

[58] Field of Search ..... 417/490, 493, 494, 499, 417/500, 501; 92/171; 123/139 B, 139 AA, 139 R

[56] References Cited

UNITED STATES PATENTS 3,759,637 9/1973 Vuaille ..... 123/139 B 3,804,559 4/1974 Staudt et al. ..... 123/139 B

FOREIGN PATENTS OR APPLICATIONS 1,365,247 5/1964 France ..... 417/494

*Primary Examiner*—C. J. Husar
*Assistant Examiner*—Edward Look
*Attorney, Agent, or Firm*—Larson, Taylor and Hinds

[57] ABSTRACT

The hydraulic head especially for an "in line" injection pump, comprises a cylinder forming a pump chamber, in which a pump piston moves, having at least one fuel supply orifice formed in its cylindrical wall. The hydraulic head has a deflector element situated axially at the level of this supply orifice to deflect a jet of fuel capable of emerging from said orifice. A delivery connector is connected to the cylinder, and is constituted by an elastic ring of cylindrical form. The ring is open and has two ends arranged to come into contact with one another, said ends being separable from one another.

5 Claims, 3 Drawing Figures

HYDRAULIC HEADS FOR INJECTION PUMPS AND THE INJECTION PUMPS THEMSELVES

The invention relates to hydraulic heads for injection pumps, of the type which comprise, on the one hand, a cylinder forming a pump chamber, in which a pump piston is intended to move, this cylinder comprising at least one fuel supply orifice formed in its cylindrical wall, the hydraulic head being provided with a deflector element situated axially at the level of this supply orifice in order to deflect a jet of fuel capable of emerging through this orifice and on the other hand, a delivery connector connected to the cylinder.

The invention relates more particularly, because it is in this case that its application seems to offer the most advantage, but not exclusively, to hydraulic heads for fuel injection pumps called "in line" pumps, that is to say whose axis of the hydraulic heads are situated in the same plane.

It is a particular object of the invention to render said hydraulic heads such that they respond to the various exigencies of practice better than hitherto and especially such that the efficiency and duration of the deflector element be improved and its assembly simplified.

According to the invention, a hydraulic head of the type defined above is characterised by the fact that the deflector element is constituted by an elastic ring of cylindrical shape, said ring being open and comprising at two ends intended to come into contact with one another, said ends being separable from one another.

Advantageously, the hydraulic head comprises a monoblock housing for the elastic ring, which housing is constituted by an annular groove bounded by shoulders serving as an axial stop for the elastic ring and so that on mounting said ring in its housing, the ends of this ring must be spaced from one another.

The inner diameter of the elastic ring, when these ends are in contact, is greater than the diameter of the housing, for example of the annular groove, around which the ring is mounted.

Advantageously, this elastic ring is formed from a metallic strip wound, for example in a helix with contiguous turns, for example at 45°, the ends of the ring coming into contact along a portion of a helix, said ring being obtained by cutting out of a cylindrical portion.

According to another feature of the invention, which can be used either independently, or in combination with the foregoing features, when the delivery connector is connected to the cylinder by a sleeve (or bush) which comprises a housing adapted to receive a widened end portion of the cylinder, said widened portion comprising the one or more fuel supply orifices of the cylinder and the sleeve being also provided with orifices intended to become facing these supply orifices, the deflector element is constituted by a cylindrical elastic ring surrounding the connecting sleeve completely and mounted free in rotation around this sleeve, said cylindrical ring being open, and the ends of this ring being adapted to become supported against one another said ends being separable from one another.

There is advantageously provided a monoblock housing machined at the periphery of the sleeve to receive said elastic ring.

The invention also relates to a deflector element, for a hydraulic head of the previously defined type, intended to be mounted on the cylinder of the hydraulic head axially at the level of the one or more fuel supply orifices of this cylinder, this deflector element being characterised by the fact that it is formed in the shape of an elastic ring, of open cylindrical form, whose ends are adapted to become supported against one another.

Preferably, this ring is constituted by a wound metallic strip.

The invention also relates to fuel injection pumps comprising at least one hydraulic head and a deflector element such as previously defined.

The invention consists, apart from the features mentioned above, of certain other features which will be more explicitly discussed below with regard to a prefered embodiment, described by way of illustration, but in no way limiting, with reference to the accompanying drawing.

Figure 2:
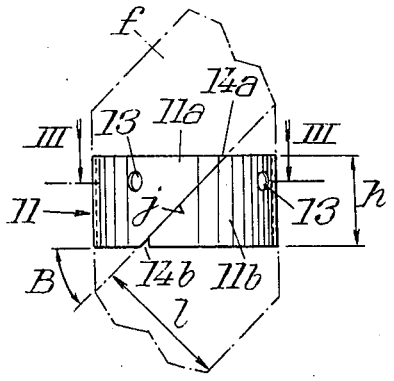
FIG. 2 is a view in elevation, on a larger scale, of the deflector element.
Figure 3:
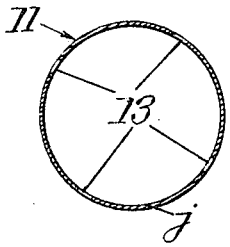

FIG. 3, lastly, is a section along the line III—III of FIG. 2.

Figure 1:
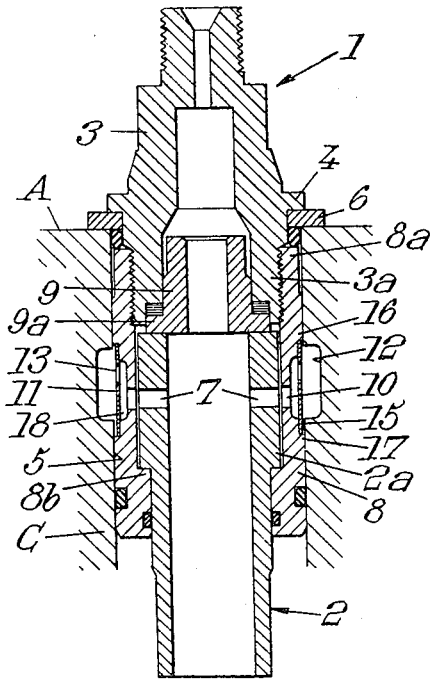
FIG. 1 shows, in axial section, a hydraulic head equiped with a deflector element according to the intention.

Referring to FIG. 1 of the drawing, there can be seen a hydraulic head 1, for an injection pump, for example an "in line" injection pump, comprising a cylinder 2 and a delivery connector 3 connected to the cylinder. This connector 3 is provided externally with a shoulder 4 adapted to constitute an axial stop for the hydraulic head 1 against a support surface A of the casing C of the pump, in which housings 5 are provided adapted to receive the hydraulic heads 1. It is to be noted that a shim 6, as shown in the drawing, may be arranged between said shoulder 4 and the surface A.

The cylinder 2 comprises an enlarged end portion **2*a* turned towards the delivery connector 3, this portion 2*a* having an outer diameter greater than that of the lower portion of the cylinder 2. Portion 2*a* comprises at least one and preferably two fuel supply orifices 7 of the bore of the cylinder 2**, these orifices being diametrically opposed.

The cylinder 2 is connected to the delivery connector 3 through a sleeve or linking bush 8. The end of this sleeve turned towards the connector 3 is internally threaded. The end **3*a* of the connector 3, externally threaded, is screwed into this end 8*a* of the sleeve. At its other end, the sleeve comprises an inner shoulder 8*b* adapted to cooperate with the transverse shoulder formed by the widening of the portion 2*a*, so as to lock the cylinder 2**.

A delivery valve, whose body 9 is alone shown in the drawing, is arranged in the delivery connector 3, at the end of the cylinder 2. This body 9 comprises a shoulder **9*a* blocked between the front wall of the widened portion 2*a*** of the cylinder and the delivery connector.

Orifices 10 are provided in the wall of the sleeve 8 and are adapted to be placed facing the orifices 7 of the cylinder 2.

A hydraulic head of this type has been described in U.S. Pat. No. 3,759,637 which is based on French Pat. No. 70. 45 911 filed 18 Dec. 1970. For all additional information regarding the arrangement of this hydraulic head with respect to the various members of the injection pump, it suffices to refer to this patent.

The hydraulic head 1 is provided with a deflector element 11 situated, as seen in FIG. 1, axially at the level of the fuel supply orifices 7 of the bore of the cylinder 2. This deflector element 11 is intended to deflect a jet of fuel capable of being produced through the orifices 7 at the end of injection, so that the wall 12 of the fuel supply manifold provided in the casing C is protected against erosion which would be produced by this jet of fuel.

The deflector element 11 is constituted by a cylindrical elastic ring completely surrounding the sleeve 8 and mounted free in rotation around this sleeve. Due to the fact of its freedom of rotation, said ring 11 can, under the action of the jet of fuel, be moved angularly with respect to the sleeve 8 and to the orifices 10 so that it is not always the same zone of the inner surface of the ring 11 which is exposed to erosion by the jet of fuel. The wear of the ring 11, due to this erosion, is distributed regularly over the inner circumference of this ring, which extends the duration of its life with respect to a ring which would be fixed relatively to the cylinder.

The ring 11 comprises orifices for the passage of fuel displaced axially, with respect to the orifices 7 and 10, so that the fuel must effect a staggered path to pass from the supply manifold of the casing, bounded by the wall 12, into the bore of the cylinder 2 or reversely. As seen in FIG. 1, these orifices 13 are staggered, with respect to the orifices 7 and 10, on the side of the delivery connector 3. Staggering in the opposite direction is also possible. Advantageously, these orifices 13 are four in number distributed at the corners of a square as seen in FIG. 3.

The elastic ring 11 forming the deflector element is capable of undergoing appreciable modification in diameter under the effect of a force of the order of that developed by the jet of fuel emerging through the orifices 7.

Advantageously, this elastic ring 11 is formed from a metallic strip *f*, that is to say a wound thin metallic sheet. This strip *f* is in the form of a strip of width *l*; this strip is wound into a helix (FIG. 2) so as to form a cylinder, the helix being preferably at 45° and the turns formed with this strip *f* wound being contiguous turns. The angle of 45° corresponds to the angle B of FIG. 2 formed between the generators of the cylinder and the contact helix *j* of the contiguous turns.

The strip *f* is preferably of hard tempered steel and its thickness is of the order 0.8 millimeter.

The ring 11 is obtained by cutting out to the desired length *h* from a cylindrical part, as is clearly seen in FIG. 2 where the ring 11 is shown in full line and the portions of the helix with contiguous turns, from which it is derived, are shown in broken line.

The ring 11 is an open ring that is to say a ring split over the whole of its width as seen in FIG. 2. This ring 11 comprises two ends 11*a*, 11*b* intended to come into contact with one another along a line of contact *j* (FIG. 2) extending over the whole of the width of the ring 11. Preferably, this line *j* is a helical portion, for example at 45°.

As can be seen in FIG. 2, indentations of triangular shape 14*a*, 14*b* exist in the wall of the ring 11 at the upper and lower ends of helical portion *j*. These indentations 14*a*, 14*b* correspond respectively to the cutting of angular portions of the ends 11*a*, 11*b*.

The elasticity of the ring 11 results for example from the fact that it relates to an open ring whose ends 11*a*, 11*b* can be separated from one another.

Due to this elasticity, the ring 11 can be mounted, as shown in FIG. 1, in a monoblock housing 15 machined at the periphery of the sleeve 8 of the hydraulic head.

This housing 15 is constituted by an annular groove whose diameter is less than the outer diameter of the major portion of the sleeve 8 so that a shoulder 16, 17 serves an axial stop for the ring 11. The shoulders 16, 17 have a diameter greater than the inner diameter of the ring 11 when the ends 11*a*, 11*b* are in contact. Due to its elasticity, said ring can be engaged around the sleeve 8, the ends 11*a*, 11*b* being separated from one another, and at the level of the housing 15, said ring closes again over the portion *j* (FIG. 2) of the helix at 45°. The inner diameter of the ring, measured when the ends 15*a*, 15*b* are in contact, is greater than the diameter of the annular groove 15 around which the ring is mounted; the play which results therefrom enables free rotation of the ring.

It is to be noted that the elasticity of said ring is favourable, also, to its freedom in rotation and that at the limit, the elastic ring could be mounted supported against the surface of the annular groove 15 without however its freedom of rotation being eliminated, by reason of its elasticity.

As appears in the drawing, the groove 15 comprises, in its middle portion, an annular recess 18 extending axially over a length less than that of the deflector element 11; the orifices 10 of the sleeve 8 open into this recess 18 as well as the orifices 13 of the ring 11.

It is clear that the ring 11, forming a deflector element, constructed according to the invention, can be mounted on hydraulic heads for an injection pump which do not comprise the sleeve 8 shown in FIG. 1.

I claim:

1. Hydraulic head for an injection pump, comprising, a cylinder forming a pump chamber in which a pump piston is intended to move, said cylinder comprising at least one fuel supply orifice formed in the cylindrical wall thereof, said hydraulic head being provided with a deflector element, disposed axially at the level of said supply orifice, for deflecting a jet of fuel capable of emerging from said orifice, and a delivery connector connected to the cylinder, said deflector element being constituted by an elastic ring of cylindrical form, said ring being circumferentially open and comprising two ends which are separable from one another, said head comprising a monoblock housing for the elastic ring comprising shoulders which define an annular groove and serve as an axial stop for the elastic ring, so that, during the mounting of said ring in said housing, the ends of the ring are separated from one another, the inner diameter of the elastic ring, when its ends are in contact, being greater than the diameter of the annular groove around which the ring is mounted.

2. Hydraulic head according to claim 1, wherein the elastic ring is formed from a wound metallic strip, the ends of the ring coming into contact along a portion of a helix.

3. Hydraulic head according to claim 1, wherein the deflector element comprises orifices staggered, along the axis of the hydraulic head, with respect to the at least one supply orifice of the cylinder.

4. Hydraulic head for an injection pump, comprising a cylinder forming a pump chamber, in which a pump piston is intended to move, this cylinder comprising at least one fuel supply orifice formed in its cylindrical wall, the hydraulic head being provided with a deflector element situated axially at the level of this supply orifice in order to deflect a jet of fuel capable of emerging through this orifice and a delivery connector connected to the cylinder by a sleeve which comprises a housing adapted to receive a widened end portion of the cylinder, said widened portion bearing the at least one fuel supply orifice of the cylinder and the sleeve being also provided with orifices intended to register with said at least one supply orfice, the deflector element being constituted by a cylindrical elastic ring completely surrounding the connecting sleeve and mounted to freely rotate around this sleeve, said cylindrical ring being circumferentially open and comprising two ends which are separable from one another.

5. Hydraulic head according to claim 4, wherein the sleeve includes a housing comprising shoulders defining an annular groove and serving as an axial stop for the ring, the ends of said ring having to be separated from one another to enable the ring to be engaged around the sleeve in said groove.

* * * * *